US011480054B2

(12) United States Patent
Dai et al.

(10) Patent No.: US 11,480,054 B2
(45) Date of Patent: Oct. 25, 2022

(54) RAPID CONSTRUCTION METHOD FOR SECONDARY LINING OF SMALL-SECTION TUNNEL

(71) Applicants: CCTEB INFRASTRUCTURE CONSTRUCTION INVESTMENT CO., LTD., Hubei (CN); CHINA CONSTRUCTION THIRD ENGINEERING BUREAU GROUP CO;LTD, Hubei (CN)

(72) Inventors: Xiaosong Dai, Hubei (CN); Nanshan Yu, Hubei (CN); Kaiyang Liu, Hubei (CN); Yisheng Ye, Hubei (CN); Haijun Zhu, Hubei (CN); Changyi Su, Hubei (CN); Qing Sun, Hubei (CN); Shangzhi Jiang, Hubei (CN); Qin Cao, Hubei (CN); Jian Cui, Hubei (CN); Lishan Cui, Hubei (CN)

(73) Assignees: CCTEB INFRASTRUCTURE CONSTRUCTION INVESTMENT CO., LTD., Hubei (CN); CHINA CONSTRUCTION THIRD ENGINEERING BUREAU GROUP CO; LTD, Hubei (CN)

( * ) Notice: Subject to any disclaimer, the term of this patent is extended or adjusted under 35 U.S.C. 154(b) by 26 days.

(21) Appl. No.: 17/228,683

(22) Filed: Apr. 12, 2021

(65) Prior Publication Data

US 2021/0231015 A1 Jul. 29, 2021

Related U.S. Application Data

(63) Continuation of application No. PCT/CN2021/081401, filed on Mar. 18, 2021.

(51) Int. Cl.
*E21D 11/40* (2006.01)
*E21D 11/18* (2006.01)

(52) U.S. Cl.
CPC ..... *E21D 11/40* (2013.01); *E21D 11/18* (2013.01)

(58) Field of Classification Search
CPC E21D 11/40; E21D 11/18; E21D 9/00; E21D 9/008; E21D 11/00; E21D 11/30;
(Continued)

(56) References Cited

U.S. PATENT DOCUMENTS 3,885,397 A * 5/1975 Fujimori ..... E21D 11/40 405/288
4,038,829 A * 8/1977 Moebus ..... E21D 11/40 405/153
2004/0177979 A1* 9/2004 Rubie ..... E21D 20/006 173/39

FOREIGN PATENT DOCUMENTS

CH 629282 * 4/1982
CN 104775834 * 7/2015
(Continued)

*Primary Examiner* — Carib A Oquendo

(57) ABSTRACT

A rapid construction method for a secondary lining of a small-section tunnel includes steps of: transporting and store secondary lining steel bars to a designated position in the tunnel with a steel bar transport vehicle and a wheel type dump truck; after the tunnel is cleaned, simultaneously constructing the secondary lining from two ends to a middle of the tunnel; constructing a lower inverted arch with a customized inverted arch formwork and then constructing an upper arch wall with a plurality of portal arch wall formwork trolleys; wherein the portal arch wall formwork trolleys form a set, and are connected by hinges, so as to construct in a curve tunnel. The rapid construction method has a long single construction section, and procedure connection is compact, thereby realizing rapid and efficient construction of the secondary lining.

9 Claims, 2 Drawing Sheets

二衬施工=secondary lining construction 混凝土浇筑=concrete pouring

(58) Field of Classification Search
CPC ..... E21D 11/28; E21D 11/36; E21D 13/00; E21D 23/00
See application file for complete search history.

(56) References Cited

FOREIGN PATENT DOCUMENTS

| | | | |
|---|---|---|---|
| CN | 105952482 | * | 5/2018 |
| CN | 105863686 | * | 10/2018 |
| CN | 112502750 | * | 3/2021 |
| JP | 2004100336 | * | 4/2004 |

* cited by examiner

二衬施工=secondary lining construction 混凝土浇筑=concrete pouring

二衬施工=secondary lining construction 混凝土浇筑=concrete pouring

RAPID CONSTRUCTION METHOD FOR SECONDARY LINING OF SMALL-SECTION TUNNEL

CROSS REFERENCE OF RELATED APPLICATION

The application is a continuation application of a PCT application No. PCT/CN2021/081401, filed on Mar. 18, 2021.

BACKGROUND OF THE PRESENT INVENTION

Field of Invention

The present invention relates to a technical field of secondary lining construction, and more particularly to a rapid construction method for a secondary lining of a small-section tunnel.

Description of Related Arts

With the rapid development of urban construction and national economy, the development of urban underground spaces is more advanced. The construction of subway tunnels, utility tunnels and even deep drainage tunnels is more common, and secondary lining construction is involved in a plurality of tunnels.

The secondary lining construction needs to perform steel bar binding, formwork installation and concrete pouring in the tunnel which is finished with the primary support. Tunnels in China, particularly small-section tunnels, are commonly constructed with a needle beam type or a through type formwork trolley.

Conventionally, secondary lining construction section of many tunnels in China is small and the working space is narrow, which make it impossible for multiple conventional formwork trolleys to operate simultaneously. In addition, during secondary lining construction for tunnels with special-shaped sections, the one-time full-section pouring construction is very difficult.

SUMMARY OF THE PRESENT INVENTION

To overcome defects in the prior art, the present invention provides a rapid construction method for a secondary lining of a small-section tunnel, which solve the above problem.

Accordingly, in order to accomplish the above objects, the present invention provides a rapid construction device for a secondary lining of a small-section tunnel, comprising: a steel bar transport vehicle, a wheel type dump truck, a customized inverted arch formwork, a self-propelled gantry crane, an electric flat car, a portal arch wall formwork trolley, and a concrete pump truck;

the steel bar transport vehicle comprises a transport flat plate, a power vehicle head and traveling wheels, wherein a supporting and blocking structure is arranged on the transport flat plate according to a shape and a single-time transportation amount of steel bars to be transported, so as to stabilize the steel bars during classified stacking and transporting; after a hole is drilled, the steel bars are hoisted to the steel bar transport vehicle through a working well, and transported to the hole to be close to a cleaned area;

the wheel type dump truck unloads the steel bars in the hole; a gantry crane structure is provided at an upper portion of the wheel type dump truck, and angle-adjustable rubber wheels are provided at a lower portion of the wheel type dump truck to walk on structural surfaces with different radians; after being transported to a storage position by the steel bar transport vehicle, the steel bars are lifted, transferred and placed by the wheel type dump truck, so as to be stacked according to use sequence;

the customized inverted arch formwork is an integral steel formwork matched with a shape of a secondary lining inverted arch; two rails are arranged on annular ribs of the customized inverted arch formwork along a tunnel direction, and adjacent formworks are butted by flanges;

the self-propelled gantry crane, the electric flat car and the customized inverted arch formwork are used as a travelling platform for removing, hoisting, transferring and installing the customized inverted arch formwork; travelling wheels are arranged at bottom portions of the self-propelled gantry crane and the electric flat car, and types and rail pitches of the travelling wheels are matched with the rails arranged on the customized inverted arch formwork;

the portal arch wall formwork trolley comprises a frame system and a formwork system, wherein the frame system has a portal structure; travelling wheels are connected to a bottom of the frame system through vertical oil cylinders to lift the portal arch wall formwork trolley; the formwork system is integrally sleeved on a periphery of the frame system, and comprises a top mold and a side mold with a hinged node therebetween; the formwork system is connected to the frame system through a hydraulic oil cylinder to support and retract the formwork system;

the concrete pump truck transport concrete from a tank car pump to a pouring site, and a size of the concrete pump truck is designed according to a tunnel section size; during construction, the concrete pump truck synchronously moves with a working face, and is located at a tail of the portal arch wall formwork trolley closest to a hole entrance; a pumping distance is no less than four flow segments; during pouring, an inverted arch is poured before an arch wall, both are poured from a far end to a near end.

Preferably, the portal arch wall formwork trolley is formed by multiple sections to suit a curve tunnel, and the sections are hinged to one another to perform plane rotation; after a formwork is established, a lateral screw rod is used for fixing and bearing loads generated by concrete pouring.

A rapid construction method for a secondary lining of a small-section tunnel based on the rapid construction device comprises steps of:

S1: after a tunnel is drilled, cleaning the tunnel and transporting the steel bars into the tunnel;

S2: sequentially constructing the steel bars from two ends to a middle of the tunnel, and integrally binding and forming at one time;

S3: constructing inverted arches of a first flow segment and a second flow segment;

S4: synchronously constructing an inverted arch of a third flow section and arch wall odd bins of the first flow segment and the second flow segment, then constructing an inverted arch of a fourth flow section and arch wall even bins of the first flow segment and the second flow segment;

S5: constructing inverted arches and arch walls from the two ends to the middle of the tunnel in sequence according to the step S4; and S6: after the inverted arch of the middle of the tunnel is closed, withdrawing the construction device of one working face, wherein the construction device of the other working face is used to finish the rest arch wall before being withdrawn from the tunnel, thereby completing secondary lining construction.

Preferably, in the step S1, the steel bars are transported into the hole by the steel bar transport vehicle, and are sequentially unloaded to each construction section of the tunnel by the wheel type dump truck; during stacking, a former die of the steel bars are stacked to a position of a latter die to reserve a steel bar working surface, so as to reduce a transporting distance of the steel bars.

Preferably, in the step S2, the steel bars are constructed from the two ends to the middle of the tunnel in sequence, and integrally installed at one time; an installation progress of the steel bars is at least one flow beat ahead of inverted arch construction.

Preferably, in the step S3, each working face has two self-propelled gantry cranes and one electric flat car, and the step S3 comprises specific steps of: hoisting the customized inverted arch formwork by the self-propelled gantry crane, and rotating by 90 degrees until a long edge of the customized inverted arch formwork is parallel to a longitudinal beam of the self-propelled gantry crane; then passing the customized inverted arch formwork through the self-propelled gantry crane, rotating to be perpendicular to the longitudinal beam, and placing on the electric flat car which transports the customized inverted arch formwork to an establishing site; transporting and installing the customized inverted arch formwork to a first secondary lining section, which is finished with steel bar binding, through another self-propelled gantry crane with a same transporting method; pouring concrete after installation from a far end to a near end; curing the customized inverted arch formwork until a certain strength is reached, then demolding and transporting the customized inverted arch formwork to a second secondary lining section which is finished with the steel bar binding with the same transporting method for installing and pouring concrete.

Preferably, in the step S4, after the inverted arch of the second flow section is constructed, the customized inverted arch formwork is transported to the third flow section for the secondary lining construction; meanwhile, the portal arch wall formwork trolley is transported to finished secondary lining inverted arch areas at the first flow section and the second flow section in the tunnel; a length of each section of the inverted arch is equally divided into n bins, and a length of each bin is equal to a length of the portal arch wall formwork trolley; during arch wall construction, 1st, 3rd, 5th . . . (2n−1)th bins are established, then the inverted arch of the third flow section and the arch wall odd bins are simultaneously poured; then the customized inverted arch formwork is transported to the fourth flow section for the secondary lining construction section with a same transporting method; meanwhile, the portal arch wall formwork trolley is moved forwards by one bin to establish 2nd, 4th, 6th . . . (2n)th bins; then the inverted arch of the fourth flow section and the arch wall even bins are simultaneously poured; during pouring, the inverted arches are poured before the arch walls, both are poured from a far end to a near end.

Preferably, in the step S5, the secondary lining construction is performed in a sequence of: 1) the inverted arch of a (2n+1)th flow segment, and the arch wall odd bins of (2n−1)th and (2n)th flow segments; and 2) the inverted arch of a (2n+2)th flow segment, and the arch wall even bins of the (2n−1)th and (2n)th flow segments.

Preferably, in the step S6, after the inverted arch is closed, the customized inverted arch formwork, the self-propelled gantry crane, the electric flat car, and the portal arch wall formwork trolley at one construction end are withdrawn from one side of the tunnel; the portal arch wall formwork trolley at the other construction end is used to finish the rest arch wall before being withdrawn from the tunnel.

In summary, compared with the prior art, the technical scheme of the present invention has the following beneficial effects:

1. The construction method is suitable for the secondary lining construction of the small-section tunnel. For the tunnel with small sections and a plurality of curve sections, the inverted arch is constructed before the arch wall, wherein rails are arranged on the formed inverted arch for the subsequent arch wall to pass. Compared with the conventional needle beam type formwork trolley, the construction space is larger, the construction operation is more convenient, the construction working surface has the personnel and material passing conditions, the construction section is longer, the arch wall can realize synchronous construction of multiple nonadjacent cabins, and the construction efficiency is greatly improved.

2. The working surface of the rapid construction method can be unfolded to realize flow operation. The whole secondary lining construction is divided into three parts: the steel bar binding, the inverted arch construction and the arch wall construction. With the three types, the construction types can be reasonably distributed, the longitudinal space of the tunnel is maximally utilized, and manpower is saved. The construction device is complete and mechanization degree is high, which greatly reduce labor intensity of workers, making the construction more efficient and safer.

BRIEF DESCRIPTION OF THE DRAWINGS

An embodiment of the present invention will be further illustrated in conjunction with the accompanying drawings, wherein.

Element reference: 1—steel bar transport vehicle, 2—wheel type dump truck, 3—customized inverted arch formwork, 4—self-propelled gantry crane, 5—electric flat car, 6—portal arch wall formwork trolley, 7—concrete pump truck, 8—(2n−1)th flow segment, 9—(2n)th flow segment, 10—(2n+1)th flow segment, 11—(2n+2)th flow segment.

DETAILED DESCRIPTION OF THE PREFERRED EMBODIMENT

Figure 1:
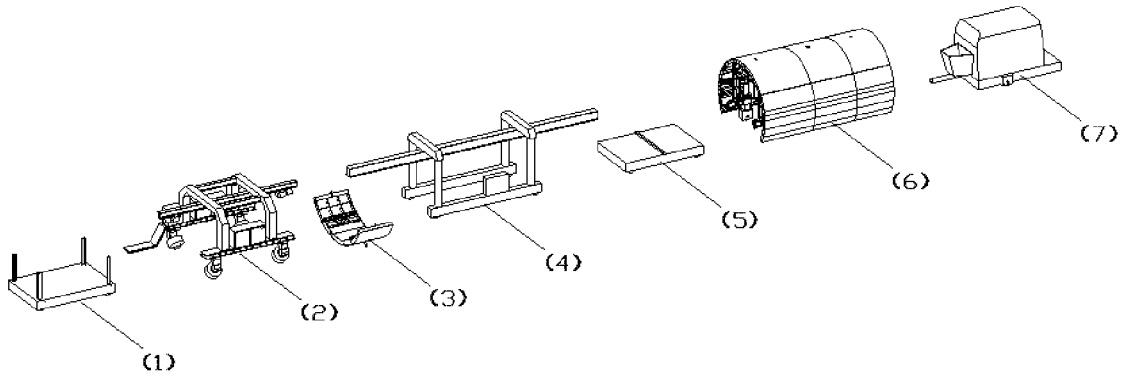
FIG. 1 is a perspective view of devices according to an embodiment of the present invention.
Figure 2:
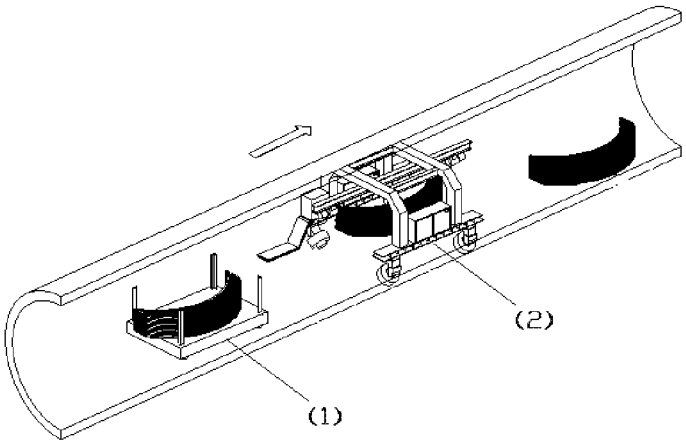
FIG. 2 is a sketch view of classified stacking of steel bars according to the embodiment of the present invention.
Figure 3:
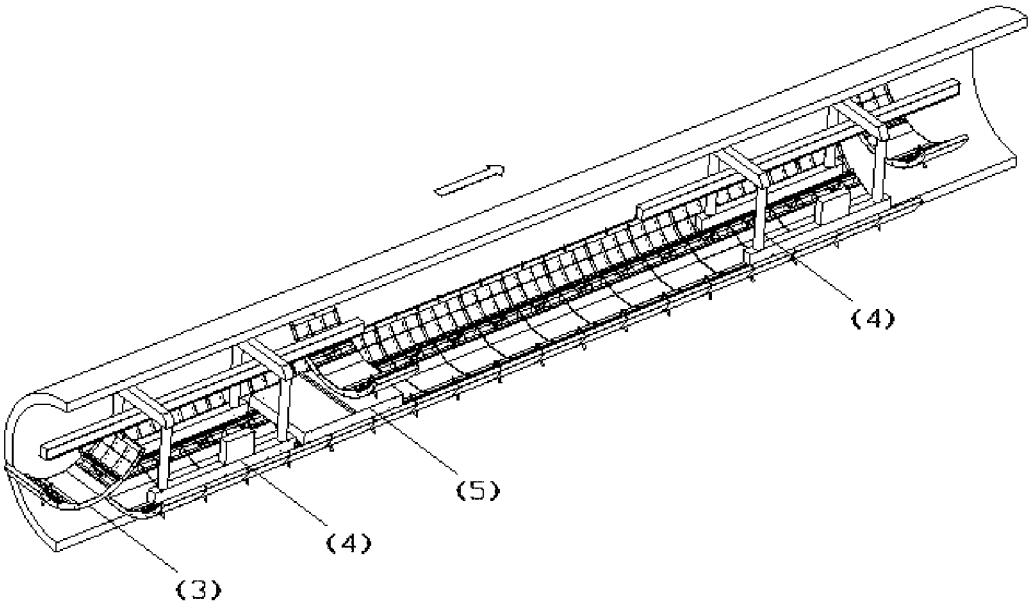
FIG. 3 is a sketch view of transporting of inverted arch formworks according to the embodiment of the present invention.
Figure 4:
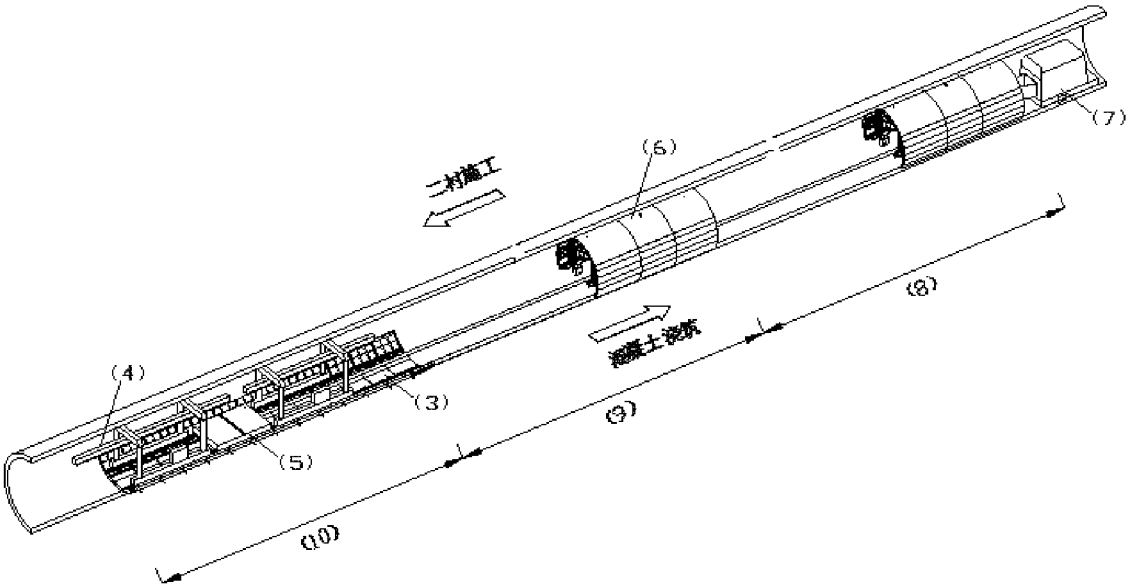
FIG. 4 is a sketch view of flow construction of inverted arches and arch wall odd bins according to the embodiment of the present invention.
Figure 5:
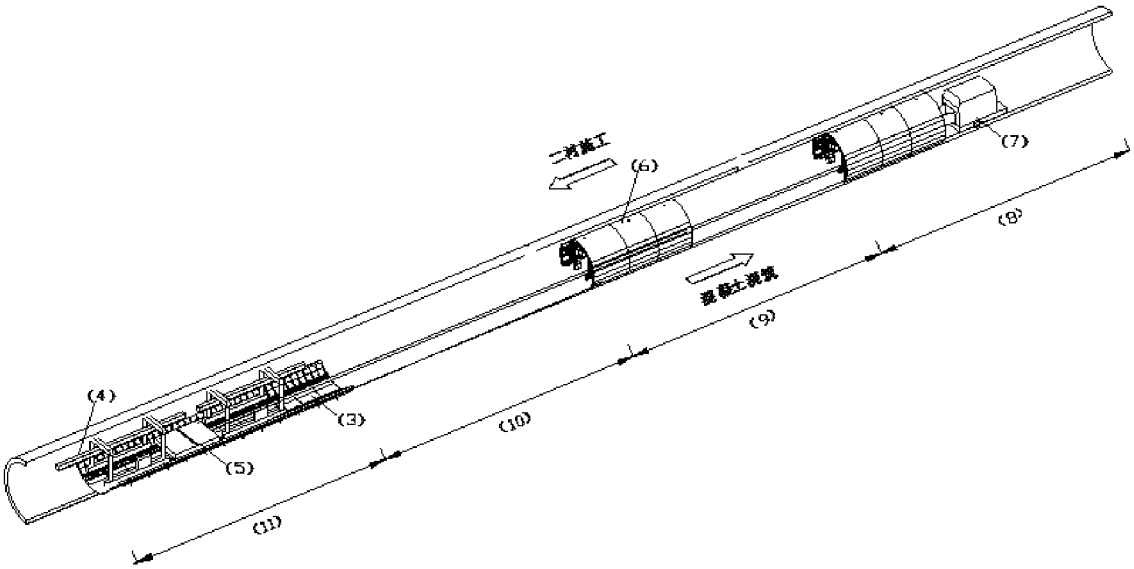
FIG. 5 is a sketch view of flow construction of inverted arches and arch wall even bins according to the embodiment of the present invention.

Referring to FIG. 1 of the drawings, a rapid construction device for a secondary lining of a small-section tunnel is illustrated, comprising: a steel bar transport vehicle 1, a wheel type dump truck 2, a customized inverted arch formwork 3, a self-propelled gantry crane 4, an electric flat car 5, a portal arch wall formwork trolley 6, and a concrete pump truck 7.

The steel bar transport vehicle 1 comprises a transport flat plate, a power vehicle head and traveling wheels, wherein a supporting and blocking structure is arranged on the transport flat plate according to a shape and a single-time transportation amount of steel bars to be transported, so as to stabilize the steel bars during classified stacking and transporting; after a hole is drilled, the steel bars are hoisted to the steel bar transport vehicle 1 through a working well, and transported to the hole to be close to a cleaned area.

The wheel type dump truck 2 unloads the steel bars in the hole; a gantry crane structure is provided at an upper portion of the wheel type dump truck 2, and angle-adjustable rubber wheels are provided at a lower portion of the wheel type dump truck 2 to walk on structural surfaces with different radians; after being transported to a storage position by the steel bar transport vehicle 1, the steel bars are lifted, transferred and placed by the wheel type dump truck 2, so as to be stacked according to use sequence.

The customized inverted arch formwork 3 is an integral steel formwork matched with a shape of a secondary lining inverted arch; two rails are arranged on annular ribs of the customized inverted arch formwork 3 along a tunnel direction, and adjacent formworks are butted by flanges.

The self-propelled gantry crane 4, the electric flat car 5 and the customized inverted arch formwork 3 are used as a travelling platform for removing, hoisting, transferring and installing the customized inverted arch formwork 3; travelling wheels are arranged at bottom portions of the self-propelled gantry crane 4 and the electric flat car 5, and types and rail pitches of the travelling wheels are matched with the rails arranged on the customized inverted arch formwork 3.

The portal arch wall formwork trolley 6 comprises a frame system and a formwork system, wherein the frame system has a portal structure; travelling wheels are connected to a bottom of the frame system through vertical oil cylinders to lift the portal arch wall formwork trolley 6; the formwork system is integrally sleeved on a periphery of the frame system, and comprises a top mold and a side mold with a hinged node therebetween; the formwork system is connected to the frame system through a hydraulic oil cylinder to support and retract the formwork system.

The concrete pump truck 7 transport concrete from a tank car pump to a pouring site, and a size of the concrete pump truck 7 is designed according to a tunnel section size; during construction, the concrete pump truck 7 synchronously moves with a working face, and is located at a tail of the portal arch wall formwork trolley 6 closest to a hole entrance; a pumping distance is no less than four flow segments; during pouring, an inverted arch is poured before an arch wall, both are poured from a far end to a near end.

A rapid construction method for a secondary lining of a small-section tunnel based on the rapid construction device comprises steps of:

Step 1: after a tunnel is drilled, withdrawing tunneling facilities and cleaning the tunnel, wherein according to pre-determined working sections, the steel bars are transported into the hole by the steel bar transport vehicle 1, and are sequentially unloaded to each construction section of the tunnel by the wheel type dump truck 2; during stacking, a former die of the steel bars are stacked to a position of a latter die to reserve a steel bar working surface, so as to reduce a transporting distance of the steel bars.

Step 2: sequentially performing steel bar binding from two ends to a middle of the tunnel, wherein the steel bars are integrally installed at one time; an installation progress of the steel bars is at least one flow beat ahead of inverted arch construction.

Step 3: installing a rail at a tunnel entrance for the self-propelled gantry crane 4 and the electric flat car 5 to move along; hoisting the self-propelled gantry crane 4 on the rail, and rotating the customized inverted arch formwork 3 to pass through the self-propelled gantry crane 4; then transporting the customized inverted arch formwork 3 from a rear end to a front end; after steel bar construction at the first construction section, hoisting the first customized inverted arch formwork 3 to a hole entrance, so that the precast rail on the customized inverted arch formwork 3 is flush with the rail outside the hole entrance; positioning the first customized inverted arch formwork 3, hoisting the customized invert arch formwork 3 in turn to connect to a the previously installed customized invert arch formwork 3, and ensuring that the rails of all the customized invert arch formworks 3 are flush, thereby forming an integral inverted arch steel mold; after all the customized inverted arch formworks 3 at the first construction section are constructed, performing concrete construction; after concrete reaches a certain strength, transporting all the customized invert arch formworks 3 in the first construction section to the second construction section for installation and concrete construction.

Step four: after inverted arch concrete at the second construction section reaches a certain strength, transporting all the customized inverted arch formworks 3 to the third construction section in the same way; meanwhile, installing rails on the finished inverted arches of the first and second construction sections for the portal arch wall formwork trolley 6 to move along; respectively establishing arch wall odd bins at the first and second construction sections with the portal arch wall formwork trolley 6; stopping the concrete pump trolley 7 at a tail portion of the first portal arch wall formwork trolley 6 at the hole entrance, wherein during pouring, the inverted arches are poured before the arch walls, both are poured from a far end to a near end.

It will be understood by those skilled in the art that the foregoing description is only one embodiment of the present invention, and is not intended to be limiting. Any modification, equivalent replacement, or improvement made within the spirit and principle of the present invention should be included in the protection scope.

What is claimed is:

1. A rapid construction device for a secondary lining of a small-section tunnel, comprising: a steel bar transport vehicle (1), a wheel type dump truck (2), a customized inverted arch formwork (3), a self-propelled gantry crane (4), an electric flat car (5), a portal arch wall formwork trolley (6), and a concrete pump truck (7);

the steel bar transport vehicle (1) comprises a transport flat plate, a power vehicle head and traveling wheels, wherein a supporting and blocking structure is arranged on the transport flat plate according to a shape and a single-time transportation amount of steel bars to be transported, so as to stabilize the steel bars during classified stacking and transporting; after a hole is drilled, the steel bars are hoisted to the steel bar transport vehicle (1) through a working well, and transported to the hole to be close to a cleaned area;

the wheel type dump truck (2) unloads the steel bars in the hole; a gantry crane structure is provided at an upper portion of the wheel type dump truck (2), and angle-adjustable rubber wheels are provided at a lower portion of the wheel type dump truck (2) to walk on structural surfaces with different radians; after being transported to a storage position by the steel bar transport vehicle (1), the steel bars are lifted, transferred and placed by the wheel type dump truck (2), so as to be stacked according to use sequence;

the customized inverted arch formwork (3) is an integral steel formwork matched with a shape of a secondary lining inverted arch; two rails are arranged on annular ribs of the customized inverted arch formwork (3) along a tunnel direction, and adjacent formworks are butted by flanges;

the self-propelled gantry crane (4), the electric flat car (5) and the customized inverted arch formwork (3) are used as a travelling platform for removing, hoisting, transferring and installing the customized inverted arch formwork (3); travelling wheels are arranged at bottom portions of the self-propelled gantry crane (4) and the electric flat car (5), and types and rail pitches of the travelling wheels are matched with the rails arranged on the customized inverted arch formwork (3);

the portal arch wall formwork trolley (6) comprises a frame system and a formwork system, wherein the frame system has a portal structure; travelling wheels are connected to a bottom of the frame system through vertical oil cylinders to lift the portal arch wall formwork trolley (6); the formwork system is integrally sleeved on a periphery of the frame system, and comprises a top mold and a side mold with a hinged node therebetween; the formwork system is connected to the frame system through a hydraulic oil cylinder to support and retract the formwork system;

the concrete pump truck (7) transport concrete from a tank car pump to a pouring site, and a size of the concrete pump truck (7) is designed according to a tunnel section size; during construction, the concrete pump truck (7) synchronously moves with a working face, and is located at a tail of the portal arch wall formwork trolley (6) closest to a hole entrance; a pumping distance is no less than four flow segments; during pouring, an inverted arch is poured before an arch wall, both are poured from a far end to a near end.

2. The rapid construction device, as recited in claim 1, wherein the portal arch wall formwork trolley (6) is formed by multiple sections to suit a curve tunnel, and the sections are hinged to one another to perform plane rotation; after a formwork is established, a lateral screw rod is used for fixing and bearing loads generated by concrete pouring.

3. A rapid construction method for a secondary lining of a small-section tunnel based on the rapid construction device as recited in claim 1, comprising steps of:

S1: after a tunnel is drilled, cleaning the tunnel and transporting the steel bars into the tunnel;

S2: sequentially constructing the steel bars from two ends to a middle of the tunnel, and integrally binding and forming at one time;

S3: constructing inverted arches of a first flow segment and a second flow segment;

S4: synchronously constructing an inverted arch of a third flow section and arch wall odd bins of the first flow segment and the second flow segment, then constructing an inverted arch of a fourth flow section and arch wall even bins of the first flow segment and the second flow segment;

S5: constructing inverted arches and arch walls from the two ends to the middle of the tunnel in sequence according to the step S4; and S6: after the inverted arch of the middle of the tunnel is closed, withdrawing the construction device of one working face, wherein the construction device of the other working face is used to finish the rest arch wall before being withdrawn from the tunnel, thereby completing secondary lining construction.

4. The rapid construction method, as recited in claim 3, wherein in the step S1, the steel bars are transported into the hole by the steel bar transport vehicle (1), and are sequentially unloaded to each construction section of the tunnel by the wheel type dump truck (2); during stacking, a former die of the steel bars are stacked to a position of a latter die to reserve a steel bar working surface, so as to reduce a transporting distance of the steel bars.

5. The rapid construction method, as recited in claim 3, wherein in the step S2, the steel bars are constructed from the two ends to the middle of the tunnel in sequence, and integrally installed at one time; an installation progress of the steel bars is at least one flow beat ahead of inverted arch construction.

6. The rapid construction method, as recited in claim 3, wherein in the step S3, each working face has two self-propelled gantry cranes (4) and one electric flat car (5), and the step S3 comprises specific steps of: hoisting the customized inverted arch formwork (3) by the self-propelled gantry crane (4), and rotating by 90 degrees until a long edge of the customized inverted arch formwork (3) is parallel to a longitudinal beam of the self-propelled gantry crane (4); then passing the customized inverted arch formwork (3) through the self-propelled gantry crane (4), rotating to be perpendicular to the longitudinal beam, and placing on the electric flat car (5) which transports the customized inverted arch formwork (3) to an establishing site; transporting and installing the customized inverted arch formwork (3) to a first secondary lining section, which is finished with steel bar binding, through another self-propelled gantry crane (4) with a same transporting method; pouring concrete after installation from a far end to a near end; curing the customized inverted arch formwork (3) until a certain strength is reached, then demolding and transporting the customized inverted arch formwork (3) to a second secondary lining section which is finished with the steel bar binding with the same transporting method for installing and pouring concrete.

7. The rapid construction method, as recited in claim 3, wherein in the step S4, after the inverted arch of the second flow section is constructed, the customized inverted arch formwork (3) is transported to the third flow section for the secondary lining construction; meanwhile, the portal arch wall formwork trolley (6) is transported to finished secondary lining inverted arch areas at the first flow section and the second flow section in the tunnel; a length of each section of the inverted arch is equally divided into n bins, and a length of each bin is equal to a length of the portal arch wall formwork trolley (6); during arch wall construction, 1st, 3rd, 5th . . . (2n−1)th bins are established, then the inverted arch of the third flow section and the arch wall odd bins are simultaneously poured; then the customized inverted arch formwork (3) is transported to the fourth flow section for the secondary lining construction section with a same transporting method; meanwhile, the portal arch wall formwork trolley (6) is moved forwards by one bin to establish 2nd, 4th, 6th . . . (2n)th bins; then the inverted arch of the fourth flow section and the arch wall even bins are simultaneously poured; during pouring, the inverted arches are poured before the arch walls, both are poured from a far end to a near end.

8. The rapid construction method, as recited in claim 3, wherein in the step S5, the secondary lining construction is performed in a sequence of: 1) the inverted arch of a (2n+1)th flow segment, and the arch wall odd bins of (2n−1)th and (2n)th flow segments; and 2) the inverted arch of a (2n+2)th flow segment, and the arch wall even bins of the (2n−1)th and (2n)th flow segments.

9. The rapid construction method, as recited in claim 3, wherein in the step S6, after the inverted arch is closed, the customized inverted arch formwork (3), the self-propelled gantry crane (4), the electric flat car (5), and the portal arch wall formwork trolley (6) at one construction end are withdrawn from one side of the tunnel; the portal arch wall formwork trolley (6) at the other construction end is used to finish the rest arch wall before being withdrawn from the tunnel.

* * * * *